United States Patent [19]

Gruenenfelder

[11] Patent Number: 5,069,952

[45] Date of Patent: Dec. 3, 1991

[54] ZIPPER TAPE

[75] Inventor: Terri P. Gruenenfelder, Gainesville, Ga.

[73] Assignee: Scovill Fasteners Inc., Clarkesville, Ga.

[21] Appl. No.: 688,243

[22] Filed: Apr. 22, 1991

[51] Int. Cl.[5] ..... B32B 23/02

[52] U.S. Cl. ..... 428/193; 139/384 B; 428/192; 428/229; 428/257

[58] Field of Search ..... 428/192, 193, 229, 257; 139/384 B

[56] References Cited

U.S. PATENT DOCUMENTS

| | | | |
|---|---|---|---|
| 2,860,668 | 11/1958 | Hindley | 139/384 B |
| 2,935,095 | 5/1960 | Carson | 139/384 B |
| 3,068,908 | 12/1962 | Firing | 139/384 B |

*Primary Examiner*—James J. Bell

*Attorney, Agent, or Firm*—Dallett Hoopes

[57] ABSTRACT

This woven tape has a beaded edge comprising a plurality of untextured yarns twisted in one direction, the yarns then being cabled in the opposite direction to form a stabilized cable. The cable is covered by two textured wrapping yarns wound in opposite directions. The warp and weft threads of the tape are woven over the covered cable to comprise a sheath.

2 Claims, 1 Drawing Sheet

Twisted yarn
Cabled yarns form cord
Covered cord
Sheath covered cord and tape

ZIPPER TAPE

BACKGROUND OF THE INVENTION

1. Field of the Invention

This invention relates to a zipper tape. More specifically, this invention relates to a zipper tape having a beaded edge over which individual metal teeth are clamped.

2. Description of Related Art including Information Disclosed under §§ 1.97 to 1.99.

A wide variety of tapes for use in metal zippers are already in the prior art. Some of these, such as the old U.S. Pat. No. 2,267,370 which issued Dec. 23, 1941 to Brozek teach the idea of a beaded edge formed by laying a cord along the edge of a tape and doubling back the tape fabric to form a cover over the cord which is then stitched. The metal teeth are then clamped over the covered cord.

In another old U.S. Pat. No. 3,068,908 which issued Dec. 18, 1962 to Firing the edge cord is actually woven into the tape.

In U.S. Pat. No. 2,935,095 which issued May 3, 1960 to W. T. Carson separate cords on either sides of the tape are bundled and woven into the tape and then coated for protection.

None of the structures of the prior art presents a tape structure which possesses suitable qualities of strength, resistance to alkaline laundry solutions and flexibility desired by industry.

SUMMARY OF THE INVENTION

The present invention is a tape for zippers comprising a woven web having a beaded edge, the edge comprising a cord consisting of a plurality of tightly packed untextured filament yarns of Nylon, each yarn being twisted in a first direction, the cord then twisted in the opposite direction to form a balanced cable. An inner and an outer textured covering yarn is wound around the cord, the inner and the outer covering yarns being tightly wound in opposite directions. The edge also includes a sheath covering the cord and covering yarns, the sheath consisting of interlaced warp and weft threads of the woven web.

The present tape seems to have the advantages long sought by industry, and the quality of the tape is attributable to the combination of textured and untextured yarns; its twisting and cabling and the weaving of the cord into the tape by a covering sheath.

BRIEF DESCRIPTION OF THE DRAWINGS

Other features and objects of the invention will be apparent from the following specification and the drawings, all of which disclose a non-limiting form of the invention. In the drawings.

DESCRIPTION OF THE PREFERRED EMBODIMENT

Figures 1, 2, 3:
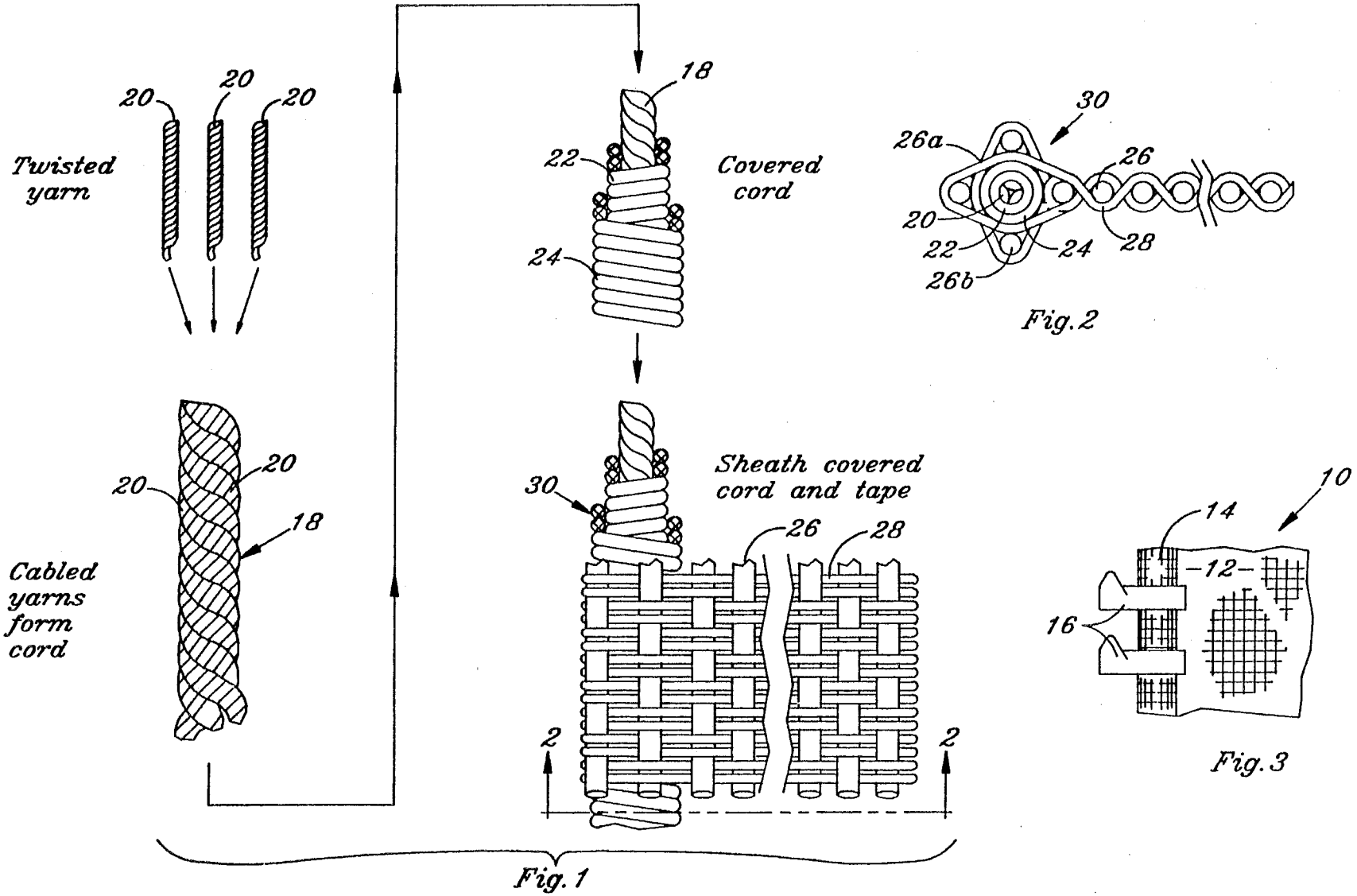
FIG. 1 is a flow diagram showing the twisted yarns, the cabled yarns, the covered cable and the woven sheath and tape.
FIG. 2 is a sectional view taken on the line 2—2 of FIG. 1.
FIG. 3 is a reduced view showing the finished beaded tape with teeth attached.

A fragment of a zipper chain embodying the invention is shown in FIG. 3 and generally designated 10. It comprises a woven tape 12 having a beaded edge 14 onto which are clamped individual metal teeth 16 in known fashion.

The product shown in FIG. 3 is best described by alluding to the process of making it. Referring now to FIG. 1, a cord 18 is formed from a plurality of twisted untextured filament yarns 20. Preferably the filament yarns are of Nylon or the like because they are highly resistant to alkaline solutions which are used in laundries. Filament yarns are used because they are less likely to have broken fibers than textured or staple yarns.

As shown, the filament yarns 20 are twisted in one direction as shown. These yarns are relatively slender for flexibility. To bring balance to the yarns, they are cabled together to form the cord 18. The cabling is a twisting in the opposite direction from the direction of the twisted yarns (as shown) to orient the separate yarns into one cord. Twisting in one direction and cabling in the opposite direction produces a balanced cord or cable.

Because the filament yarns are untextured, they pack more tightly together to provide increased density ad reduce the movement of air and moisture through the cord. This property helps in protecting the inner core of the cabled cord from being attacked. Textured and spun yarns, on the other hand, would permit more openness in the yarn and make the yarn more susceptible to attack.

The cabled cord 18 is then covered with a textured or spun yarn, or from filament or staple fibers. The covering thus provides a rougher texture with more contact points to prevent longitudinal slippage in the sheath. Filament yarn alone is very smooth; therefore, the cabled cord without the covering would slip. The textured covering is important in maintaining stability of the beaded edge while the fastener elements are being clamped thereon.

The covering serves to longitudinally stabilize the cabled cord. As shown (FIG. 1) the cabled cord is covered with two textured yarns 22 and 24. The yarns are wrapped in opposite directions and are wrapped such that the covering comes in direct contact with the cabled cord at all points and, thus, becomes an integral part of the cord. The tightly wound cover works to keep the filament yarns cabled together thus eliminating separation of the yarns and loss of compactness. Wrapping directly on the cord provides uniform and dense coverage.

The thus covered cord is then woven into the tape. As shown, the warp threads 26 extend parallel to the cord and the weft threads 28 extend perpendicular to and inter-lace with the warp threads 26, as shown in FIG. 2. The weft threads 28 have a bifurcated pattern: some of the warp threads **26*a* in the area of the covered cord are above the cord and some 26*b* are below the cord. The weft threads thus interlace with both the upper and the lower warp threads around the cord to thereby form a sheath 30**.

The sheath 30 provides protection of the covered cabled cord 24, 22, 18 from the fastener elements. Direct contact with the fastener elements would otherwise result in damage to the yarns at the point of contact. Damage to the cord could cause more degradation of the cord and thus strength loss.

The sheath 30 also serves as a sleeve on the edge of the tape so that only one cord 18, 22, 24 needs to be used. Running one cord instead of two decreases the cord breaks that can occur at weaving.

The sheath-covered cord and tape shown in FIG. 1 is then introduced to a clamping apparatus.

The individual teeth 16 are applied to the beaded edge. Because the cord is covered by the textured or spun yarn and is balanced, it is able to maintain the stability of the beaded edge while the fastener elements are being clamped on. During the clamping, the two rough surfaces (the cover 22, 24 and the sheath 30) come in further contact assuring that the cord is also being gripped by the element.

It will be apparent to those skilled in the art that only one variation of the invention is disclosed herein but it will also be apparent that the embodiment is capable of many variations and modifications. Thus, the invention is not limited to the embodiment shown but may be defined as arrangements encompassed by the following claim language including any extensions of the right to exclude others from making, using or selling the invention as permitted by the doctrine of equivalents.

What is claimed is:

1. A tape for zippers comprising a woven web having a beaded edge, the beaded edge comprising:

a. a cord consisting of a plurality of tightly packed untextured filament yarns of Nylon, each yarn being twisted in a first direction, the cord then twisted in the opposite direction to form a balanced cable, b. an inner and an outer covering yarn wound around the cord, the covering yarn having texture, the inner and the outer covering yarns being tightly wound in opposite directions, and c. a sheath covering the cord and covering yarns, the sheath consisting of interlaced warp and weft threads of the woven web, whereby when the zipper teeth are clamped onto the beaded edge, the sheath and covering yarns will protect the cord from contact with the teeth and the covering yarns help protect the cord from attack by laundry solutions.

2. A tape for zippers as claimed in claim 1 wherein the cord consists of a plurality of tightly packed untextured filament yarns covered by textured yarns.

* * * * *